US006179698B1

(12) United States Patent
Lam

(10) Patent No.: US 6,179,698 B1
(45) Date of Patent: Jan. 30, 2001

(54) SELF-ALIGNING TOOL FOR HANDS-FREE CROSS-SECTIONING OF AN INTEGRATED CIRCUIT

(75) Inventor: Chung Lam, Fremont, CA (US)

(73) Assignee: Sun Microsystems, Inc., Palo Alto, CA (US)

( * ) Notice: Under 35 U.S.C. 154(b), the term of this patent shall be extended for 0 days.

(21) Appl. No.: 09/357,469

(22) Filed: Jul. 20, 1999

(51) Int. Cl.[7] ..... B24B 41/06
(52) U.S. Cl. ..... 451/364; 125/35; 451/340
(58) Field of Search ..... 451/63, 41, 364, 451/388, 392, 393, 394, 397, 398, 403, 404, 918, 340; 125/35

(56) References Cited

U.S. PATENT DOCUMENTS 2,431,469 * 11/1947 Eyles ..... 125/35
3,809,050 * 5/1974 Chough et al. ..... 125/35
6,030,282 * 2/2000 Mahnapour ..... 451/364

* cited by examiner

*Primary Examiner*—Derris H. Banks
(74) *Attorney, Agent, or Firm*—Daniel Vaughan; Park & Vaughan LLP

(57) ABSTRACT

A tool is provided for cross-sectioning an integrated circuit in a hands-free mode of operation. The tool comprises an enclosure or cage having a passageway through which a sample—such as an integrated circuit, which may be encased in epoxy or some other substance—is brought into contact with an abrasive surface such as a milling disk. A wall or plate of the enclosure is adjustable in order to accommodate a variety of sample sizes, including both dies and packages. During the grinding or polishing of the sample the rotation of the milling disk helps stabilize the sample against the adjustable wall and one or more other walls of the enclosure. The enclosure is situated at a selectable position along a frame or guide that is mounted above the milling disk. Releasable connectors are used to secure the enclosure in a selected position yet allow it to be relocated as the milling disk becomes worn. The stability of the cross-sectioning tool allows a sample to be cross-sectioned without constant attention by a human operator, and the sample can be removed, examined and replaced without adjusting the enclosure, adjustable wall or the frame. The force of gravity keeps the sample in contact with the milling disk as the sample is ground, and may be augmented by a small weight. Because the arrangement of the enclosure and adjustable wall need not be changed to examine the sample or move it to an unworn section of the milling disk, the sample easily re-aligns itself each time it is returned to the enclosure.

22 Claims, 2 Drawing Sheets

SELF-ALIGNING TOOL FOR HANDS-FREE CROSS-SECTIONING OF AN INTEGRATED CIRCUIT

BACKGROUND

This invention relates to the field of failure analysis of integrated circuits and semi-conductors. More particularly, a self-aligning tool is provided for cross-sectioning an integrated circuit in a hands-free mode of operation.

When an integrated circuit (IC) fails to operate, or fails to operate as expected, it may be subjected to failure analysis in order to determine the cause of the failure. For example, when a newly designed circuit is first manufactured, it is usually tested to ensure that it operates correctly. If it does not, operational testing of the part may be able to identify a symptom of the fault or the general area in which the fault may lie, but may not be able to determine the exact cause of the failure (e.g., bad soldering, an open or shorted line). Therefore, one goal of failure analysis is to determine the cause of the part's failure by examining one or more areas or suspected points of failure.

Thus, failure analysis often requires locating a specific element (e.g., junction, line) or area of an IC for close examination (e.g., under a powerful microscope). Typically, a cross-section of the IC is taken at the suspected area in order to gain an unobstructed view. Because of the microscopic level of detail involved (e.g., sub-micron units of measure in some cases), however, it is essential that just enough of the IC is removed to expose the desired element, but no more.

If a relatively large portion of the circuit must be removed little precision is required at first—i.e., the part may be sawn or cut roughly in order to remove most of the extraneous material. However, in the latter stages of the cross-sectioning effort great care and precision are required in order to uncover the desired area without introducing any new fractures or other errors. Many failure analysis operations employ an abrasive surface, such as a milling disk (e.g., a circular piece of sandpaper), to grind away the edge of the IC to uncover the suspected fault.

One tool for cross-sectioning an IC with a milling disk is a hand-held tool. A die may be secured to this tool, which is then guided by the operator to grind away the unneeded portion of the IC. The die can be removed from the tool for examination (e.g., to determine if the area of interest has been uncovered yet).

This tool is deficient in several respects. First, it requires continuous human operation and attention regardless of how much of the IC needs to be ground away in order to reach the target area. Also, the angle at which the die is cross-sectioned depends upon the angle at which the operator holds the tool. Because there is no mechanism for ensuring that the same angle is maintained throughout the cross-sectioning, the operator may inadvertently remove too much of the IC. In addition, this tool can only be used with IC dies, not packages. Finally, this tool is relatively expensive to use due to the need for constant human attendance.

Another tool for cross-sectioning an IC by grinding an edge with a milling disk is more automated than the tool described above, but still suffers from significant shortcomings. This tool, which can accommodate dies but not packages, includes a mechanical arm to hold an IC for grinding. The IC must be encased in wax, however, in order to be held by the arm. In addition, the arm must be continually adjusted to ensure that the IC is placed in contact with the abrasive surface. The IC must be removed from the arm to be examined, thus requiring the wax to be removed (e.g., melted) prior to examination, and then re-applied if further grinding is necessary. Repeatedly mounting the IC in wax makes it very easy to misalign the IC in between grinding evolutions, and the effort required to repeatedly prepare the IC for examination and then grinding adds a significant amount of time to a failure analysis operation.

Thus, what is needed is a cross-sectioning tool that can operate without a human operator's continuous participation and which facilitates easy re-alignment of an IC that is being cross-sectioned so as to maintain the same angle of cross-sectioning. Also, the tool should be able to handle ICs of various sizes, including both dies and packages.

SUMMARY

In one embodiment of the invention a tool is provided for facilitating the cross-sectioning of an integrated circuit (IC). In this embodiment the tool is capable of operation without continuous human activity and accepts ICs of various sizes. Further, the tool is self-aligning so that after an IC is removed from the tool, examined, and replaced, the IC returns to substantially the same alignment that it had prior to its removal.

In this embodiment the tool includes an enclosure, such as a carriage or cage, which partially or fully defines a passage. At one end of the passage an IC may be inserted or removed. The other end of the passage opens upon an abrasive surface that is used to grind or polish the IC. The enclosure includes two or more fixed walls to help stabilize the circuit, and an adjustable wall allows the tool to accommodate ICs of various sizes (e.g., dies and packages). The adjustable wall is, in one embodiment of the invention, continuously movable along tracks or guides that form part of the enclosure. Further, the adjustable wall is configured to be releasably secured in a selected positions along the tracks so as to stabilize an IC and help the IC maintain a particular orientation (e.g., angle) to the abrasive surface.

The tool also includes a frame comprising a plurality of rails or guides along which the enclosure may be relocated. In one embodiment of the invention the enclosure can be positioned at virtually any location along the frame. Further, the enclosure is releasably securable in a selected location, similar to the semi-permanent manner in which the adjustable wall may be located within the enclosure.

During a cross-sectioning operation the frame provides a base or support for the enclosure, which stabilizes the IC for grinding and polishing as it is in contact with the abrasive surface. In one embodiment of the invention the force of gravity is sufficient to maintain contact between the IC and the abrasive surface. However, in an alternative embodiment a small weight or force may be applied to the IC.

Because the enclosure may be selectably positioned at various locations along the frame, as one portion of the abrasive surface becomes worn, the IC can be relocated to a portion that is less worn. In various embodiments of the invention different types of releasable connectors, such as screws and wing nuts, are used to movably secure the adjustable wall within the enclosure and the enclosure within the frame.

DETAILED DESCRIPTION

The following description is presented to enable any person skilled in the art to make and use the invention, and is provided in the context of particular applications of the invention and their requirements. Various modifications to the disclosed embodiments will be readily apparent to those skilled in the art and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

In particular, various materials that may be used in manufacturing embodiments of the invention are identified below, as are a variety of means for coupling elements of these embodiments. Other construction materials and coupling means possessing similar properties are also suitable and are envisioned within the scope of the invention.

In one embodiment of the invention a self-aligning hands-free tool is provided for facilitating the cross-sectioning of an integrated circuit (IC). The tool is designed to accept ICs of various sizes, including dies (e.g., individual chips) as well as packages (e.g., an IC assembled with connectors for insertion in a socket). In this embodiment the IC is brought into contact with an abrasive surface (e.g., a milling disk) that grinds off portions of the circuit to uncover an area or element to be examined. Illustratively, the milling disk is circular in shape, and different disks having a range of coarseness may be used during the cross-sectioning. A milling disk may be rotated at a constant or varying rate, depending upon how much of the IC needs to be removed to uncover the target area. In alternative embodiments of the invention abrasive means having other configurations may be applied to the IC. For example, a belt sander or abrasive material moving in a non-circular pattern may be employed. In yet another alternative embodiment, the tool may be configured to rub an IC against a stationary abrasive.

Figure 1:
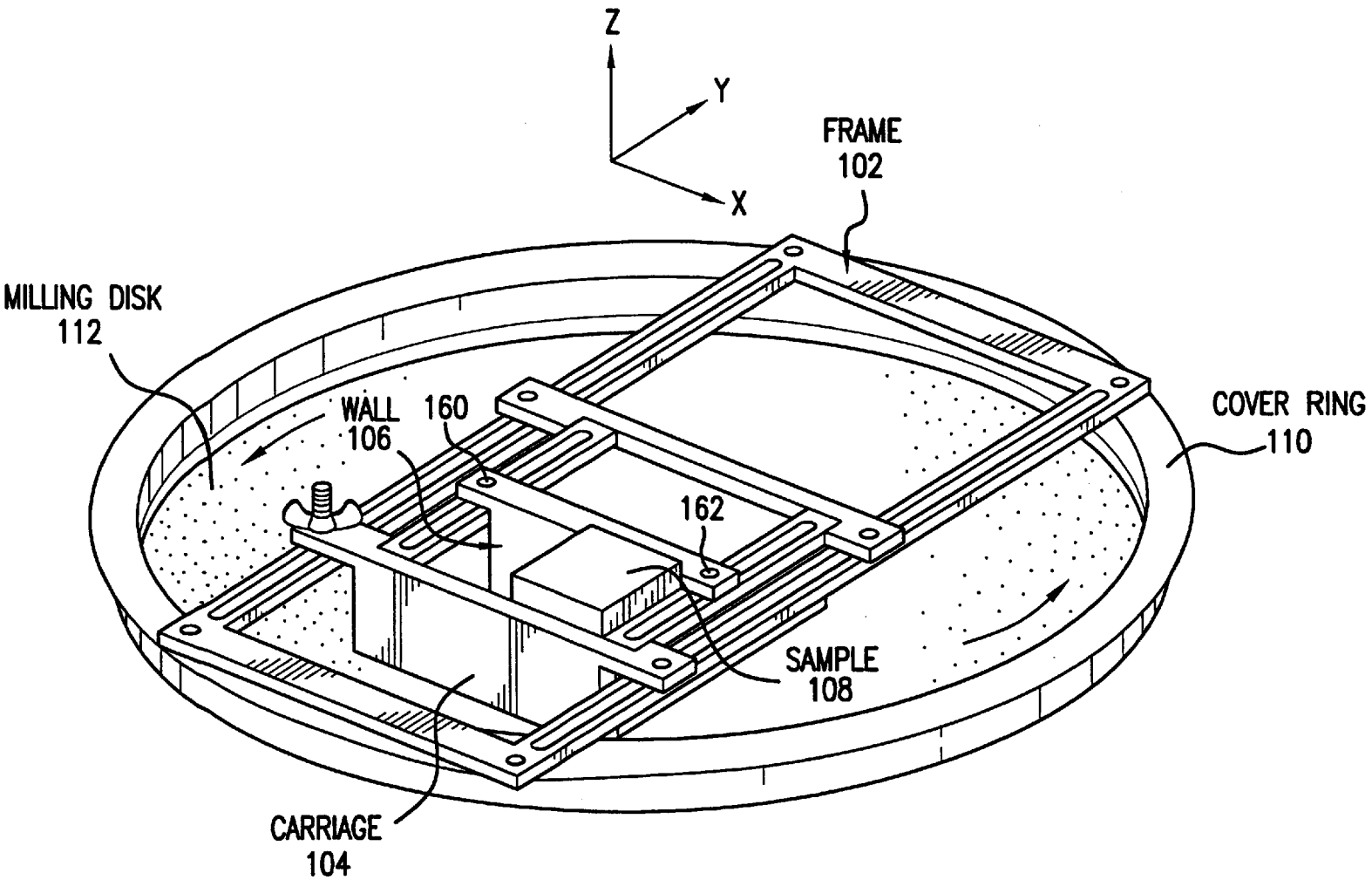
FIG. 1 is a block diagram depicting one embodiment of the present invention as it may be installed on a cover ring encompassing a milling disk.
Figure 2:
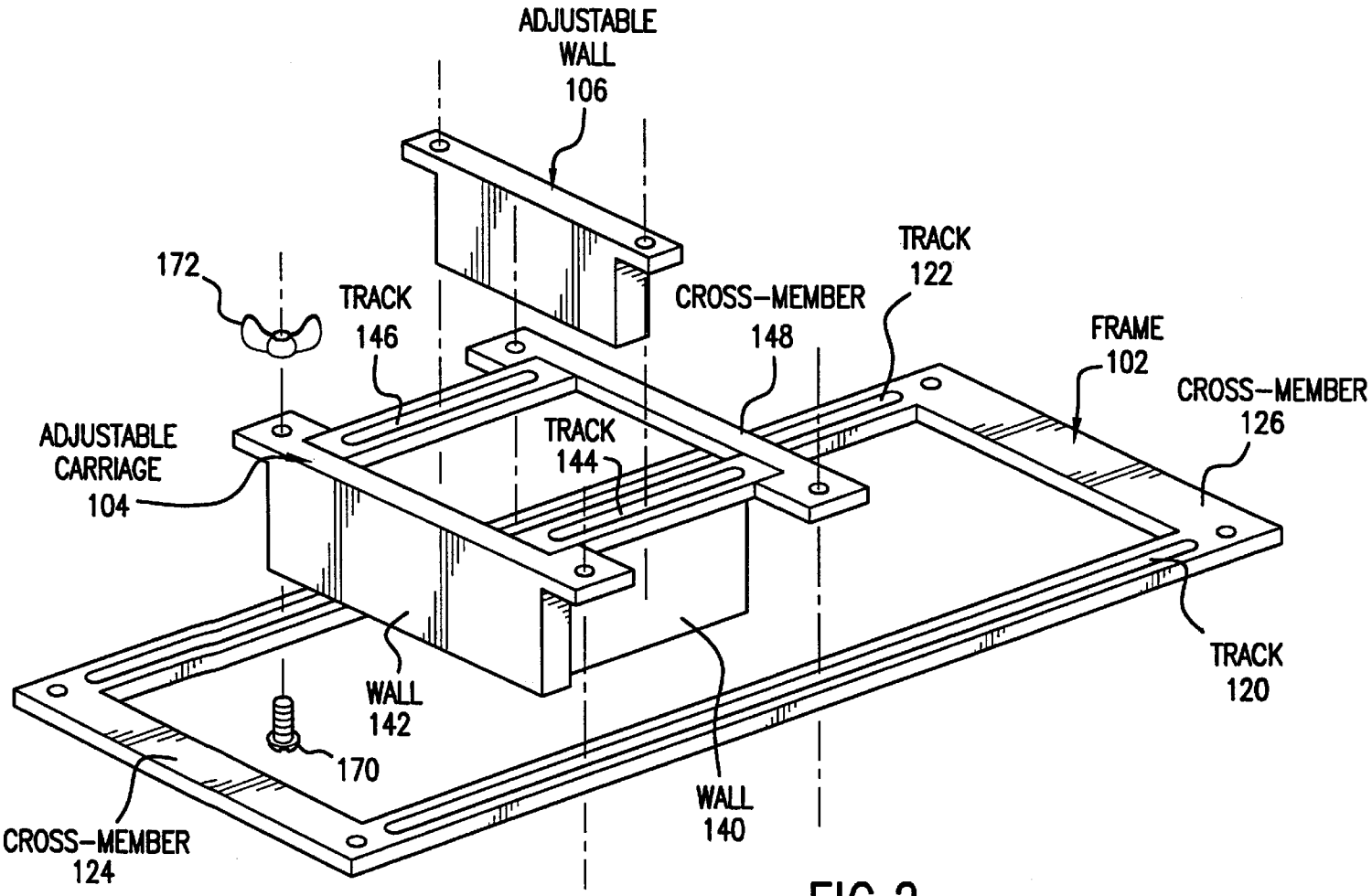
FIG. 2 is a perspective view of the embodiment of the invention depicted in FIG. 1.

FIG. 1 depicts one embodiment of cross-section tool 100 mounted on a cover ring of a milling disk. FIG. 2 is a perspective view of cross-section tool 100, demonstrating one configuration in which its components may be assembled.

Cross-section tool 100 in this embodiment includes frame 102, adjustable carriage 104 and adjustable wall 106. Sample 108 comprises an IC to be cross-sectioned. Sample 108 may, for example, constitute an IC encased in epoxy, plastic or other material (e.g. a fast-curing acrylic). Particularly with small samples, enclosure within epoxy yields a more manageably sized object for fitting in the cross-section tool. In addition, mounting an IC in epoxy or other stabilizing material promotes edge retention by resisting damage to the edge of the IC (e.g., splintering, cracking) during cross-sectioning.

In FIG. 1, cover ring 110 provides a convenient mounting surface for tool 100 above milling disk 112. Other arrangements for positioning tool 100 above the abrading surface are similarly envisioned. Illustratively, the milling disk rotates in an anti-clockwise direction, as viewed from above, at a variable or fixed rate.

Coordinate axes are depicted in FIG. 1 for reference purposes. In the illustrated coordinate system the length of frame 102 and carriage 104 extend parallel to the y-axis (e.g., across a diameter of cover ring 110), their width along the x-axis and sample 108 is inserted and removed parallel to the z-axis. Note that frame 102 may be positioned across a diameter of the cover ring or milling disk (e.g., over the center of the disk) or may be mounted off-center.

During a cross-sectioning operation, carriage 104 may be fixed in position at any location along the length of frame 102 using fasteners such as screw 170 and wing nut 172. Carriage 104 may, however, bring the full surface of milling disk 112 to bear on sample 108 just by being relocatable along one radius of the disk.

For grinding and polishing, sample 108 is inserted into carriage 104 and wall 106 is positioned to hold the sample in place yet allow it to be easily removed and replaced. Wall 106 is adjustable in order to accommodate samples of various dimensions and is fixed in a position by fasteners such as screws and wing nuts. While the sample is being ground or polished by milling disk 112, no manual assistance is required from a human operator to hold the sample in place. Further, the configuration of carriage 104 and wall 106 facilitates the self re-alignment of sample 108 as it is re-inserted in tool 100 after being examined.

In this embodiment, frame 102 includes tracks, rails or guides 120, 122 and cross-members 124, 126. The configuration of tracks 120, 122 allow carriage 104 to be temporarily or permanently secured at a position of choice along frame 102. In this embodiment the lengths of frame 102 and tracks 120, 122 are determined by the diameter of cover ring 110, but in alternative embodiments frame 102 may be adjustable in length and/or width. Tracks 120, 122 are continuous open slits in this embodiment, thereby allowing carriage 104 to be secured at virtually any location, but may alternatively be configured to limit the locations at which the carriage may be positioned. For example, a track may alternatively comprise one or more discrete apertures or indentations.

Adjustable carriage 104 includes walls 140, 142, tracks 144, 146 and cross-member 148. Tracks 144, 146 perform similar roles to those of tracks 120, 122 of frame 102 in that they allow adjustable wall 106 to be situated parallel to wall 142 at virtually any location along tracks 144, 146. Also similar to tracks 120, 122, tracks 144, 146 may comprise any configuration of apertures, slits, indentations, obstructions and the like, suitable for securing the adjustable wall. The embodiment depicted in FIGS. 1 and 2 demonstrate that tracks 144, 146 may be configured to allow adjustable wall 106 to be continuously movable along the entire length of the apertures forming the tracks. In other words, in the illustrated embodiment the releasable connectors securing wall 106 to tracks 144, 146 need merely be loosened, not removed, in order to allow the adjustable wall to be relocated along the tracks (e.g., to accommodate samples of varying sizes).

Thus, adjustable wall 106 snugly ensconces sample 108 in carriage 104 and helps stabilize the sample during grinding and polishing. The adjustable wall also facilitates re-alignment of the sample whenever it is returned to the tool (e.g., after the cross-sectioned edge is examined). In particular, adjustable wall 106 helps the sample maintain a particular orientation (e.g., angle) to the abrasive surface, which is important in producing a clear cross-section of the sample.

The orientation of frame 102 to cover ring 110 may be chosen arbitrarily in the embodiment of FIGS. 1 and 2 as long as carriage 104 can be positioned in the frame so that the rotation of milling disk 112 will bring a portion of its abrasive surface into contact with sample 108. However, mounting the frame astride the center of the milling disk ensures the availability of the full surface of the disk for grinding or polishing. Then, as the surface of milling disk 112 becomes worn (i.e., in a circular pattern), carriage 104 and sample 108 may be relocated along frame 102 to a location above a portion of the milling disk that is less worn.

For most samples, the force of gravity will be sufficient to keep the sample in contact with the milling disk as the encased IC is ground and polished. However, the amount of plastic than an IC is encased in may be augmented, both to facilitate handling and to lend enough weight to the sample to ensure continuous, hands-free operation. A short IC, for example, may be encased in a tall plastic envelope so that the sample will extend above carriage 104 for easy grasping. Another method of ensuring adequate force on a sample is to place a small object or weight on top of the sample after it is lodged in carriage 104. Adding weight to a sample may also accelerate the grinding or polishing process.

It can be seen in FIGS. 1 and 2 that the rotation of milling disk 112 forces sample 108 into the alcove formed by adjustable wall 106 and walls 140, 142 of carriage 104. Thus, in the presently described embodiment, in which carriage 104 includes just two walls, the carriage is primarily functional along one-half of the diameter of milling disk 112 (i.e., from cross-member 124 to one-half the length of frame 102. To use carriage 104 in the other half of frame 102 the carriage is removed from frame 102 and rotated 180 degrees before being re-inserted in the frame. However, because of the rotational nature of milling disk 112, carriage 104 generally only needs to be positioned along one-half the length of frame 102. In alternative embodiments of the invention walls may be added under track 146 and/or cross-member 148 so that carriage 104 may be used in any position along frame 102 without being re-oriented. This alternative embodiment is particular suited for use with a non-circular abrading surface, such as a belt sander, in which maximum use of the surface requires greater flexibility in the positioning of carriage 104 and sample 108.

In FIGS. 1 and 2, adjustable wall 106 is secured to carriage 104 and carriage 104 is secured to frame 102 at multiple points by fastening means. Illustratively, the fastening means may include screw 170 and wing nut 172. One skilled in the art will appreciate that the use of releasable connectors such as these facilitates the relocation of wall 106 or carriage 104 yet allows for secure placement of these components to provide stability as an IC is cross-sectioned. For example, screw and wing nut combinations at locations 160, 162 are easily loosened so that wall 106 may be slid along tracks 144, 146 and then tightened in a new position (e.g., for a new sample) without having to detach the connector combinations.

Various other combinations or configurations of fasteners, connectors and anchors may be employed to secure carriage 104 and/or adjustable wall 106 as long as the combination enables a movable yet positionally stable platform for sample 108. Some combinations may include clamp or vise-like arrangements, hooks, prongs, etc. For example, in one alternative embodiment of the invention a track may consist of a series of threaded apertures suitable for receiving a screw. In this embodiment wall 106 may be secured to tracks 144, 146 by screws introduced downward at locations 160, 162. In another alternative embodiment one or more of the tracks depicted in FIGS. 1 and 2 may comprise a series of apertures or indentations configured to receive a gear or wheel. In this alternative embodiment the gear or wheel may be rotated to reposition carriage 104 and/or wall 106 and may include locking means for securing the carriage or adjustable wall at a particular position. Other suitable means for securely positioning carriage 104 and adjustable wall 106, while allowing their repositioning as needed, will be apparent to one of skill in the art, and embodiments of the invention are not limited to any particular means.

As with carriage 104 and wall 106, frame 102 may be secured to cover ring 110 via any suitable stable means, such as screws, bolts, nails, clamps, glue, etc. In one alternative embodiment of the invention frame 102 may be affixed to, or included as part of, the cover ring by the manufacturer of the cover ring. Further, cross-members 124, 126 may be omitted in one or more embodiments of frame 102, particularly where tracks 120, 122 are permanently mounted or affixed to cover ring 110 with sufficient stability to support carriage 104.

In the illustrated embodiment of the invention milling disk 112 comprises an abrasive surface or film of sandpaper, emery or the like. Suitable milling disks include, but are not limited to, silicon carbide grinding paper, aluminum oxide microfinishing film, lapping film and polishing cloths used in combination with powders such as alumia.

Disks and abrasives of varying coarseness may be used during different stages of the cross-sectioning of an IC. For example, a very coarse disk may be used until the cross-sectioning begins to approach an area of the IC that is to be examined. Then, one or more finer-grained disks may be used as the area becomes closer to exposure. Finally, when the area is exposed or is close to exposure a very fine-grained polishing surface (e.g., a polishing cloth with alumia powder) may be used to finish the cross-sectioning and give a smooth and clean finish to the area in order to prepare it for examination under a microscope.

Typically, when cross-sectioning an IC with a milling disk the sample is repeatedly ground or polished and then examined to determine if additional grinding or polishing is required. The amount of material ground from the IC between examinations may vary greatly over the course of the cross-sectioning. In addition, the rate of rotation of a milling disk is typically adjusted during the cross-sectioning so as to provide fine control over the amount of the IC that is removed between examinations. For example, the closer the area of interest is to being exposed, the less material needs to be removed. Thus, depending on the coarseness of milling disk 112 very few rotations, or even less than one rotation, may be applied between one examination and the next. In particular, during the polishing phase or the end of the grinding phase, the amount of material that is to be removed may be measured in microns or even less than a micron.

Frame 102, adjustable carriage 104 and adjustable wall 106 may be constructed from a variety of materials with sufficient rigidity. The construction material may be metallic (e.g., stainless steel, aluminum) or non-metallic (e.g. plastic, graphite or other composite) that provides these characteristics and that does not easily shed flakes, chips, splinters that could damage sample 108. A rigid material may be preferred in order to lend stability to tool 100 and sample 108 and thus facilitate the grinding and polishing of an optimal cross-section. Advantageously, the interior surfaces of carriage 104 and wall 106 are relatively smooth so that sample 108 may be moved freely in the z-direction during cross-sectioning and may be easily extracted from and re-inserted into tool 100 without repositioning adjustable wall 106.

The foregoing descriptions of embodiments of the invention have been presented for purposes of illustration and description only. They are not intended to be exhaustive or to limit the invention to the forms disclosed. Many modifications and variations will be apparent to practitioners skilled in the art. Accordingly, the above disclosure is not intended to limit the invention; the scope of the invention is defined by the appended claims.

What is claimed is:

1. An apparatus for facilitating cross-sectioning of an integrated circuit, comprising:

a carriage configured to accept an integrated circuit for cross-sectioning by an abrasive surface, said carriage comprising two or more walls defining a passage for said integrated circuit to said abrasive surface;

an adjustable wall configured to releasably stabilize said integrated circuit in said carriage; and one or more guides for positioning said carriage in proximity to said abrasive surface.

2. The apparatus of claim 1, wherein said integrated circuit may be removed from said apparatus for examination and replaced in said apparatus without adjusting said adjustable wall.

3. The apparatus of claim 1, wherein said guides are configured to facilitate the releasable securing of said carriage in a selectable position in relation to said abrasive surface.

4. The apparatus of claim 1, wherein each of said guides comprises one or more apertures configured to facilitate the releasable securing of one or more of said carriage and said adjustable wall to said guides.

5. The apparatus of claim 1, wherein said carriage comprises one or more tracks configured to facilitate the releasable securing of said adjustable wall to said carriage.

6. The apparatus of claim 1, wherein said tracks enable said adjustable wall to be continuously movable along said tracks to accommodate integrated circuits of varying dimensions.

7. The apparatus of claim 1, wherein said integrated circuit, when placed in said carriage, is forced toward said abrasive surface by gravity.

8. An apparatus for cross-sectioning an integrated circuit with an abrasive surface, comprising:

a frame mounted above an abrasive surface, said frame comprising one or more tracks athwart said abrasive surface;

a carriage locatable in a selectable position along said tracks, said carriage comprising two or more walls disposed about a channel configured to receive an integrated circuit; and an adjustable wall releasably securable to one of said carriage and said frame to stabilize said integrated circuit in said channel;

wherein said carriage is releasably securable in said selectable position.

9. The apparatus of claim 8, wherein said abrasive surface is a milling disk and said frame is mounted to a cover ring encircling said milling disk.

10. The apparatus of claim 8, wherein said carriage is releasably secured at said selectable position on said tracks.

11. The apparatus of claim 10, wherein said carriage is releasably secured with a connector comprising a screw and a wing nut.

12. The apparatus of claim 8, wherein said adjustable carriage comprises a plurality of tracks configured for releasably securing said adjustable wall to said carriage.

13. The apparatus of claim 12, wherein said adjustable wall is continuously movable along said tracks to accommodate integrated circuits of varying dimensions.

14. The apparatus of claim 8, wherein said adjustable wall and said walls of said adjustable carriage are substantially perpendicular to said abrasive surface.

15. The apparatus of claim 8, wherein said integrated circuit is placed in said channel edge-first.

16. The apparatus of claim 15, wherein said integrated circuit is partially encased in a stabilizing material prior to placing said integrated circuit in said channel.

17. An apparatus for facilitating the cross-sectioning of an integrated circuit by an abrasive surface, comprising:

a frame comprising a first set of tracks, wherein said tracks are mounted across an abrasive surface;

a sample cage configured to stabilize a sample during cross-sectioning of said sample by said abrasive surface, said sample cage comprising:

one or more supports configured to facilitate the releasable securing of said cage to said first set of tracks; and a plurality of walls;

wherein said supports and said plurality of walls define a passage for receiving said sample for contact with said abrasive surface; and an adjustable wall releasably securable to said sample cage to stabilize said sample;

wherein said sample comprises an integrated circuit.

18. The apparatus of claim 17, wherein said frame further comprises a cross-member connecting a first track of said first set of tracks to a second of said parallel tracks.

19. The apparatus of claim 17, further comprising a releasable connector configured to releasably secure said sample cage to said first set of tracks.

20. The apparatus of claim 19, wherein said releasable connector comprises a screw and a wing nut.

21. The apparatus of claim 17, wherein said sample cage further comprises a second set of tracks configured to facilitate the releasable securing of said adjustable wall to said sample cage.

22. The apparatus of claim 21, wherein said adjustable wall is continuously movable along said second set of tracks.

* * * * *